US006499636B1

(12) United States Patent
McCool

(10) Patent No.: US 6,499,636 B1
(45) Date of Patent: Dec. 31, 2002

(54) GARMENT PROTECTOR FOR HANGERS

(76) Inventor: Lynda McCool, 4326 Calle Real, #111, Santa Barbara, CA (US) 93110

( * ) Notice: Subject to any disclaimer, the term of this patent is extended or adjusted under 35 U.S.C. 154(b) by 0 days.

(21) Appl. No.: 09/968,571

(22) Filed: Oct. 2, 2001

Related U.S. Application Data

(60) Provisional application No. 60/237,722, filed on Oct. 5, 2000.

(51) Int. Cl.[7] ..... A41D 27/22
(52) U.S. Cl. ..... 223/98; 223/85
(58) Field of Search ..... 223/98, 85

(56) References Cited

U.S. PATENT DOCUMENTS 2,828,899 A * 4/1958 Zuckerman ..... 223/98
6,227,423 B1 * 5/2001 Gates ..... 223/98

* cited by examiner

*Primary Examiner*—John J. Calvert
*Assistant Examiner*—James G Smith
(74) *Attorney, Agent, or Firm*—Robert M. Sperry

(57) ABSTRACT

An improved clothing protector comprising a cover for clothes hangers shaped to slip over the hook of the hanger and to be supported by the wings of the hanger and formed two panels of foam material, such as polyurethane, having substantial thickness, such as ½ inch, which have their butt edges joined along their upper edges, leaving a space to receive the hook of the hanger, and formed with a slip-resistant surface. After joining, the panels to tend to flare out, thereby providing a surface of substantial area for supporting an article of clothing.

7 Claims, 1 Drawing Sheet

GARMENT PROTECTOR FOR HANGERS

RELATED CASES

This invention is described in my Provisional Application Ser. No. 60/237,722, filed Oct. 5, 2000.

FIELD OF INVENTION

This invention relates to clothes hangers and is particularly directed to improved means for protecting clothing supported by clothes hangers from developing undesired creases.

PRIOR ART

Clothes hangers are conventionally formed of wire or plastic and are used to suspend items of clothing from hooks or bars for storage, for example, in closets, wardrobes and the like. Unfortunately, most hangers are quite thin. Unfortunately, some clothing items, such as blouses, shirts and the like are hung on the hangers, the hangers tend to cause unsightly creases, making it necessary to press the clothing before wearing. However, pressing clothing each time it is to be worn is time-consuming and annoying. To overcome this problem numerous types of hanger adapters have been provided heretofore. However, many of the prior art hanger adapters have been complex devices which have been expensive to produce and complicated to use. Other prior art hanger adapters have created more problems than they solved. Also, many of the prior art hanger adapters have had sharp corners or edges which have tended to tear the clothing or have, themselves, caused undesired creases in the clothing. In addition, clothing articles which are large sized, have wide necks, light weight or sheer often tend to slip off of conventional clothes hangers, even when prior art hanger adapters are used. Thus, none of the prior art clothing protectors have been entirely satisfactory.

BRIEF SUMMARY AND OBJECTS OF INVENTION

These disadvantages of the prior art are overcome with the present invention and an improved clothing protector is provided which is simple to use and inexpensive to produce, yet which ensures that no undesired creases will be formed in the clothing and that no sharp points, corners or edges will contact the clothing to cause rips or tears and which will tend to prevent articles of clothing from slipping off of the hanger and which can quickly and easily be transferred from one clothes hanger to another as desired.

These advantages of the present invention are preferably attained by providing an improved clothing protector comprising a cover for clothes hangers shaped to slip over the hook of the hanger and to be supported by the wings of the hanger and formed two panels of foam material, such as polyurethane, having substantial thickness, such as ½ inch, and having a slip-resistant surface, which have their butt edges joined along their upper edges, leaving a space to receive the hook of the hanger. After joining, the panels tend to flare out, thereby providing a surface of substantial area for supporting an article of clothing.

Accordingly, it is an object of the present invention to provide an improved clothes hanger adapter.

Another object of the present invention is to provide an improved clothing protector for use with clothes hangers.

A further object of the present invention is to provide an improved clothing protector which is simple to use and inexpensive to produce.

An additional object of the present invention is to provide an improved clothing protector which ensures that no undesired creases will be formed in the clothing.

Another object of the present invention is to provide an improved clothing protector which ensures that no sharp points, corners or edges will contact the clothing to cause rips or tears.

A further object of the present invention is to provide an improved clothing protector which can quickly and easily be transferred from one clothes hanger to another as desired.

A specific object of the present invention is to provide an improved clothing protector comprising a cover for clothes hangers shaped to slip over the hook of the hanger and to be supported by the wings of the hanger and formed two panels of foam material, such as polyurethane, having substantial thickness, such as ½ inch, and having a slip-resistant surface, which have their butt edges joined along their upper edges, leaving a space to receive the hook of the hanger. After joining the panels tend to flare out, thereby providing a surface of substantial area for supporting an article of clothing.

These and other objects and features of the present invention will be apparent from the following detailed description, taken with reference to the figures of the accompanying drawing.

DETAILED DESCRIPTION OF THE INVENTION

Figure 1:
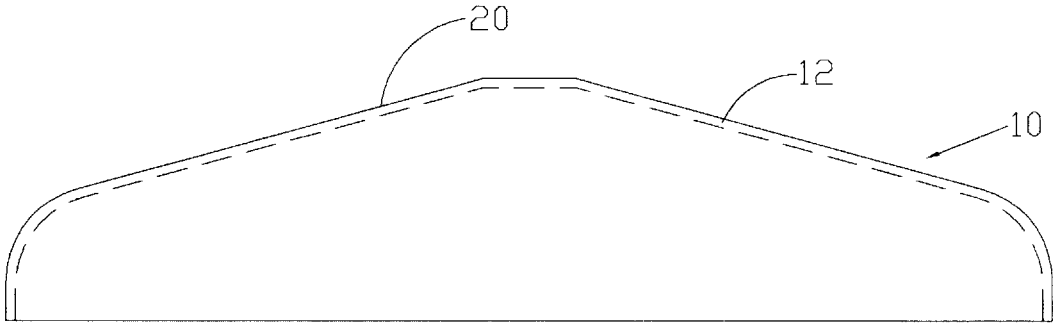
FIG. 1 is a side view showing a clothing protector embodying the present invention.
Figure 2:
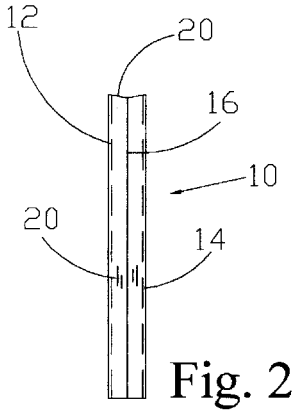
FIG. 2 is an end view of the clothing protector of FIG. 1.
Figure 3:
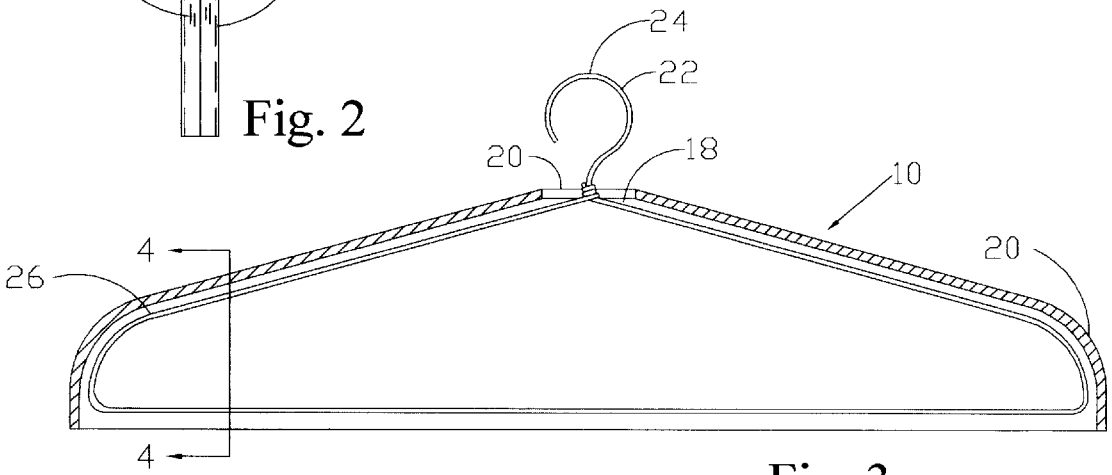
FIG. 3 is a vertical section through the clothing protector of FIG. 1, showing the clothing protector mounted on a clothes hanger.
Figure 4:
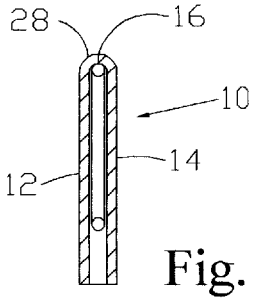
FIG. 4 is a transverse section through the clothing protector of FIG. 3, taken on the line 4—4 thereof.

In that form of the present invention chosen for purposes of illustration, FIG. 1 shows a clothing protector, indicated generally at 10, comprising two ¼ to one inch thick sheets 12 and 14 of soft, fluffy material, such as polyurethane foam. Preferably, sheets of ½ inch thickness are used and are each cut to generally conform to the shape of the wing portions of a clothes hanger, as seen in FIG. 1, which have their butt edges secured together by suitable means, such as sewing, gluing, welding, sealing or the like, along the sides thereof, as seen at 16 FIG. 2. An opening 18 is provided adjacent the upper edges 20 of the sheets 12 and 14, as seen in FIG. 3, to allow passage therethrough of the hook portion 22 of a typical clothes hanger 24. As seen in FIG. 3, a pair of wing portions 26 of the clothes hanger 24 project outwardly from the hook portion 22 and serve to support the clothing protector 10. Because the type of material used to form the sheets 12 and 14, when they are joined together, the sheets 12 and 14 tend to flare outwardly and downwardly from each other, as best seen in FIG. 4. This serves to provide maximum area for the upper surface 28 of the clothing protector 10 which precludes creasing of articles of clothing supported thereby. Furthermore, because the clothing protector 10 is formed of thick material, it serves to prevent any sharp points or edges of the clothes hanger 24 from contacting the clothing and, hence, prevents cuts, tears or rips in the clothing. Also, because the material of the sheets 12 and 14 has a slip-resistant surface, articles of clothing hung on the clothing protector 10 tend to remain on the protector and, hence, on the hanger 24 and do not drop onto the floor.

In use, the user slips the hook portion 22 of a clothes hanger 24 through opening 18 of the clothing protector 10 which allows the wings 26 of the clothes hanger 24 to support the clothing protector 10. As stated above, the clothing protector 10 is formed of two sheets 12 and 14 of fluffy material which are secured together along the butt edges thereof As seen in FIG. 4, this causes the two sheets 12 and 14 to flare outwardly and downwardly to provide a maximum surface area 28 for supporting an article of clothing. This area 28 serves to preclude wrinkles or creases from being formed in the article of clothing. Also, the thickness of the sheets 12 and 14 serves to protect the article of clothing against any sharp points or edges on the clothes hanger 24 and, hence, prevents tears or rips, while the slip-resistant surface of the sheets 12 and 14 prevents articles of clothing from sliding off of the protector 10 and, hence, from dropping off of the hanger 24 onto the floor.

Obviously, numerous variations and modifications can be made without departing from the spirit of the present invention. Therefore, it should be clearly understood that the form of the present invention described above and shown in the figures of the accompanying drawing are illustrative only and are not intended to limit the scope of the present invention.

What is claimed is:

1. A clothing protector for use with a clothes hanger having a hook portion and a pair of wing portions projecting outwardly from said hook portion, said protector comprising:

two sheets of soft fluffy material formed generally in the shape of said wing portions attached to each other along the butt edges thereof and having an opening adjacent the top of said sheets to allow passage therethrough of said hook portion of said hanger, said protector being inverted to cause said protector to overlie said hanger and to flare laterally outward therefrom.

2. The clothing protector of claim 1 wherein:

said material is foam material.

3. The clothing protector of claim 1 wherein:

said material is polyurethane foam.

4. The clothing protector of claim 1 wherein:

said sheets each have a thickness in the range of ¼ inch to one inch.

5. The clothing protector of claim 1 wherein:

said sheets each have a thickness of ½ inch.

6. The clothing protector of claim 1 wherein:

said sheets are formed with a slip-resistant surface.

7. The clothing protector of claim 1 wherein:

said sheets have their butt edges secured together.

* * * * *